United States Patent [19]

Kustka

[11] Patent Number: 4,555,231

[45] Date of Patent: Nov. 26, 1985

[54] UNITY CANDLE

[76] Inventor: D. Lucinda Kustka, 1128 Surrey Rd., Papillion, Nebr. 68046

[21] Appl. No.: 689,335

[22] Filed: Jan. 7, 1985

[51] Int. Cl.[4] ..... F23D 3/16

[52] U.S. Cl. ..... 431/288; D26/6

[58] Field of Search ..... 431/126, 288, 289, 291, 431/295; D26/6

[56] References Cited

U.S. PATENT DOCUMENTS

| | | | |
|---|---|---|---|
| D. 236,234 | 8/1975 | Hansen | D26/6 |
| 735,724 | 8/1903 | DeWoody | 431/295 |
| 2,196,509 | 4/1940 | Turner | 431/126 |
| 2,310,019 | 2/1943 | Hamblet | 431/288 |
| 3,388,960 | 6/1968 | Cangialosi | 431/288 |
| 3,582,251 | 6/1971 | Concannon | 431/288 |
| 3,730,674 | 5/1973 | Gross | 431/288 |

FOREIGN PATENT DOCUMENTS

| | | | |
|---|---|---|---|
| 12071 | 5/1956 | Denmark | 431/288 |
| 188888 | 2/1888 | France | 431/288 |
| 77725 | 5/1868 | United Kingdom . | |

*Primary Examiner*—Margaret A. Focarino

[57] ABSTRACT

A unity candle includes two separate half sections with separate wicks on the adjoining surfaces of the two half sections. As the half sections are moved into registered engagement, the flames from the separate wicks merged into a single flame of increased size and intensity which melts the wax of the candle to fuse the half sections together. The invention contemplates an improved method of symbolizing the joining of a couple in matrimony by placing the two half sections of the unity candle in spaced-apart relation, having the wicks of the half sections lit by respective individuals of the couple and then having the couple place the two half sections together with the adjoining surfaces in registered engagement to form a single unified candle.

8 Claims, 5 Drawing Figures

UNITY CANDLE

BACKGROUND OF THE INVENTION

The present invention is directed generally to a unity candle and more particularly to an improved unity candle comprised of two or more half sections with separate wicks on the adjoining surfaces of the sections.

The invention is further directed to an improved method of symbolizing the joining of a couple in matrimony, using the split unity candle of the present invention.

In religious ceremonies for weddings and renewal of marriage vows, it is often traditional for the couple to light a unity candle. Generally, this has been done by both individuals of the couple taking small separate candles and jointly lighting a single large unity candle.

Whereas this traditional ceremony embodies some symbolism of the two flames becoming one, it has been found that this symbolism can be expanded and made more vivid and apparent with the improved unity candle of the present invention.

Whereas the ceremonial use of unity candles has heretofore been limited to nuptial ceremonies, it has been found that the symbolism afforded by multiple section unity candles has application to non-nuptial ceremonies as well.

Accordingly, a primary object of the invention is to provide an improved unity candle and ceremonial method of symbolizing the joining of a couple in matrimony.

A more specific object of the invention is to provide a unity candle comprising split half sections with separate wicks on the adjoining surfaces of each of the two half sections.

Another object is to provide an improved unity candle having a structure which results in a noticeably larger flame when the half sections of the unity candle are joined together.

Another object is to provide an improved unity candle having a structure which results in the physical bonding of the two half sections of the candle when they are brought together.

Another object is to provide an improved unity candle having at least three sections with a separate wick on each section.

Another object is to provide an improved unity candle which is simple in construction, easily lit, and capable of vivid symbolism in connection with a marriage ceremony.

SUMMARY OF THE INVENTION

The unity candle of the present invention, in the preferred embodiment thereof, is a split candle comprising a pair of elongated upright candle sections, each having upper and lower ends, an exterior surface and an exposed interior or engagement surface. Each half section has a wick positioned closely adjacent the exposed engagement surface and preferably centered thereon. The engagement surfaces of the respective half sections are matched with one another so that, upon placement of the matched engagement surfaces in registered engagement, a single candle is formed. The wicks are so positioned on the respective candle sections that they are placed in adjacent relation when the matched engagement surfaces of the half sections are brought together. As a result, the flames from the separate wicks are merged into a single noticeably larger and brighter flame.

The invention furthermore contemplates an improved ceremonial method for symbolizing the joining of a couple in matrimony using the split unity candle of the present invention. The two half sections are first placed apart after which the two wicks are lit by respective individuals of the couple. The lit half sections are then brought together by the couple to form a single candle having a single flame of greater size and intensity than the flames of either of the individual half sections. Further symbolism is achieved by having parents of the couple hand them respective lighting tapers for use in lighting the half sections, whereupon the tapers are extinguished by the couple prior to joining the half sections together.

Another embodiment of the unity candle includes three separate sections, each having a wick so positioned that when the three sections are brought together, the wicks are placed in adjacent relation to support a single flame. The unity candle of this embodiment finds ceremonial use in the dedication or baptismal ceremony to symbolize the relation between the two parents and child.

DESCRIPTION OF THE PREFERRED EMBODIMENT

Figure 1:
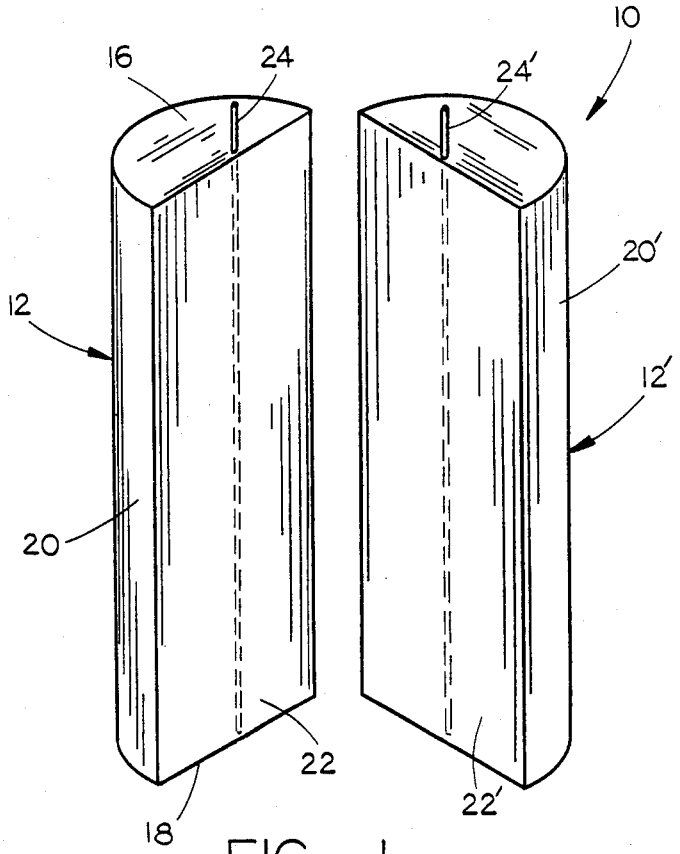
FIG. 1 is a perspective view of the unity candle showing the separate half sections in spaced-apart relation.

The unity candle 10 of the present invention is shown in the drawings as comprising a pair of elongated upright candle sections 12 and 12'. Since the candle sections are preferably constructed as the mirror image of one another, like reference numerals will be used to refer to like parts of each.

Figure 2:
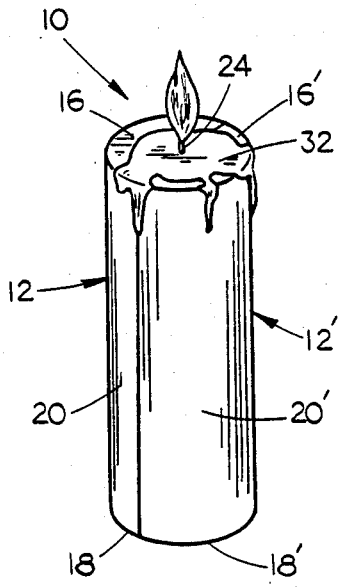
FIG. 2 is a reduced perspective view of the unity candle with the half sections placed in registered engagement and bonded together by melted wax.
Figure 3:
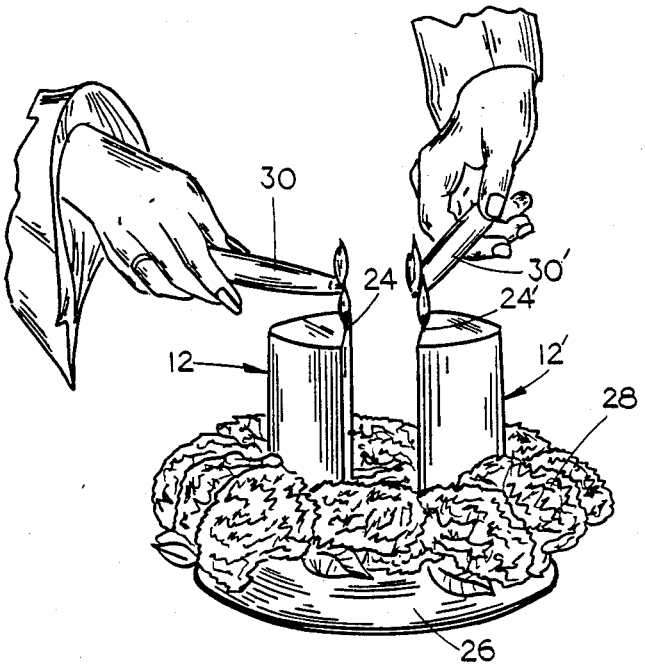
FIG. 3 is a diagrammatic perspective view of the separate half sections of the unity candle being lit with separate lighting tapers.

Half section 12 has upper and lower ends 16 and 18, an exterior surface 20 and an exposed interior or engagement surface 22. The engagement surfaces 22 and 22' of the half sections 12 and 12' are a matched pair such that, upon placement of the matched engagement surfaces in registered engagement as illustrated in FIG. 2, a single candle is formed.

An elongated wick 24 is provided on half section 12 at a position closely adjacent the exposed engagement surface 22 thereof. The wick extends upwardly from the upper surface 16 and is transversely positioned on the half section 12 so that it is placed in adjacent relation with the wick 24' of half section 12' when the two halves are placed together in registered engagement as shown in FIG. 2.

Whereas in the preferred embodiment of the candle shown in the drawings, the engagement surfaces 22 and 22' are flat and the exterior surfaces 20 and 20' are semi-cylindrical, this shape is not critical. The engagement surfaces could be curved, waved or stepped, as desired so long as the half sections can be easily placed together in registered engagement. Likewise, it is preferable that the wicks 24 and 24' actually intersect the engagement surfaces 22 and 22' but these could be slightly embedded in the candles so long as the flames from the respective wicks are merged into one when the half sections are joined together. It is also preferred that the wicks 24 and 24' be transversely centered on their respective half sections so that the resulting candle will have a centrally disposed wick.

The symbolism afforded by the structural features of the improved unity candle of FIGS. 1 and 2 will be apparent in the following description of the method of using the unity candle. This symbolism finds its basis in sacred scripture: "From the beginning of creation, God made them male and female. For this cause a man shall leave his father and mother, and the two shall become one flesh. What therefore God has joined together, let no man separate." Mark 10:6–9. "For this cause, a man shall leave his father and mother, and shall cleave to his wife, and they shall become one flesh." Genesis 2:24.

The preferred method or procedure for use of the unity candle includes the following steps. First, the unity candle 10 is placed with the half sections 12 and 12' in spaced-apart relation, possibly on a stand 26 laden with flowers 28. Separate lighting tapers 30, 30' or candles and a lighter are placed in the church pews beside each set of parents. At the appropriate time in the wedding ceremony, the bride and groom go to the parents. Each set of parents light a lighting taper and give it to their son or daughter. The bride and groom then proceed to the unity candle and each one lights their half of the candle. They then extinguish the flame of the lighting taper. Finally, the bride and groom move the two half sections of the candle into registered engagement to form one candle.

The two parts of the unity candle 10 symbolize the bride and groom that have pledged their vows before God and their guests, to leave their families and form a new union of one. The parents giving their children the lighted taper or candle, express their willingness to let their children leave and cleave and form a new family independent of their parents. It expresses the desire of the parents to give their blessing to this new union. Blowing out the lighting tapers by the bride and groom represents their willingness to leave their families and cleave to their new mate and form a new family. As the bride and groom place their halves of the unity candle together, it symbolizes their desire to become one with the other. As the flames merge, they become one with a larger and brighter light. This expresses the strength and impact they will have together. As the candle burns, the wax melts as indicated at 32 in FIG. 2, and the two half sections 12 and 12' are fused together and are not easily separated. Further scriptural support is found in the following passages. "In the Lord, neither is woman independent of man, nor is man independent of woman." I Corinthians 11:11. "Let your light shine before men in such a way that they may see your good works, and glorify your Father who is in heaven." Matthew 5:16.

Figure 5:
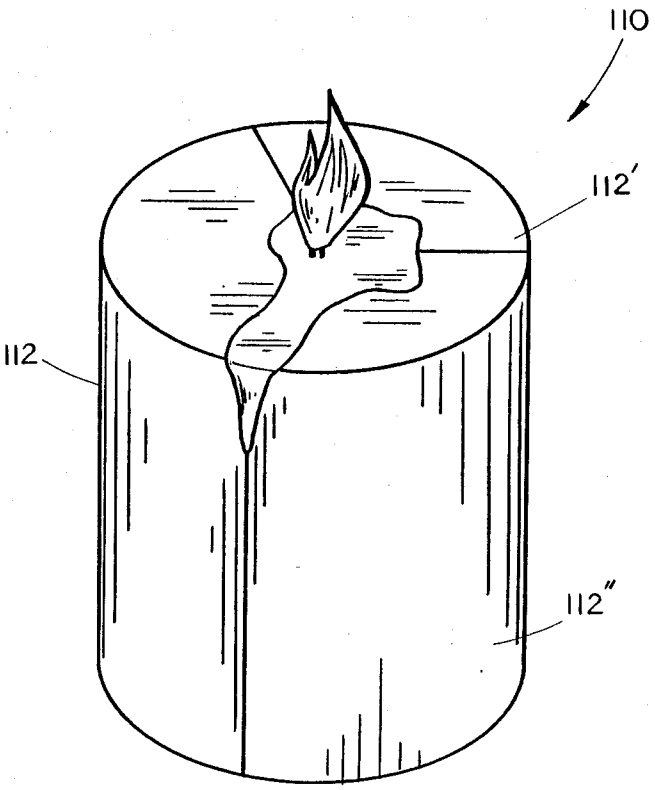
FIG. 5 is a perspective view of the unity candle of FIG. 4 with the sections placed in registered engagement and bonded together by melted wax.
Figure 4:
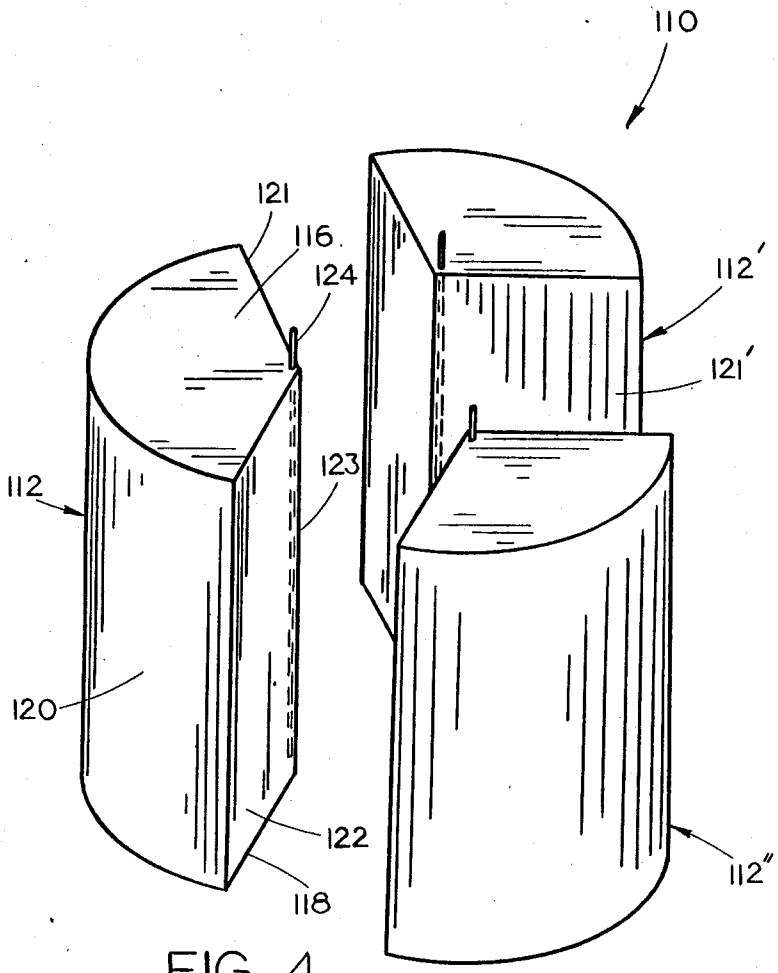
FIG. 4 is a perspective view of an alternate embodiment of the unity candle showing three separate sections in spaced-apart relation.

FIGS. 4 and 5 illustrate an alternate embodiment of the invention wherein the unity candle 110 includes three sections 112, 112' and 112''. Since the three sections are preferably identical, only one will be described in detail with like numerals referring to like parts of each.

Candle section 112 has an upper surface 116, a lower end 118, an exterior surface 120 and a pair of engagement surfaces 121 and 122. Candle section 112 is generally wedged-shaped so that the engagement surfaces 121 and 122 form an angle defining an upright apex 123. Likewise, the sections are generally pie-shaped so that the exterior surfaces 120 are arcuate and joined to form a cylindrical exterior surface for the single candle formed from the joined sections as shown in FIG. 5.

Each candle section 112 includes a wick 124 situated on or closely adjacent the apex thereof so that when the candle sections 112 are placed in adjacent relation with the matched engagement surfaces 121 and 122 of the respective sections in registered engagement, the flames from the separate wicks will be merged into one.

When used in a Dedication or Baptismal Ceremony, the separate sections of the three part candle symbolize the father, mother and child. The ceremonial process of using the candle includes the following steps. The pastor may light the father's and mother's portions of the candle. They then place their candle sections with the child's candle section. This symbolizes the willingness of the parents to follow the commandments of the Lord, to teach their children according to the Holy Scriptures, and then the light of the Lord will transfer from the parents to the children.

Relevant scriptural passages for this use of the unity candle of the invention in a baptismal ceremony include the following. "The Bible commands us to love the Lord, our God, with all our heart, and with all our soul and with all our might, and to teach these commandments to our sons and daughters, when we sit in our house, when we walk by the way, and when we lie down and rise up." Deuteronomy 6:5–7. "Fathers, do not provoke your child to anger, but bring them up in the discipline and instruction of the Lord." Ephesians 6:4. "I have come as light into the world, that everyone who believes in me, may not remain in darkness." John 12:46.

It will be apparent that the improved unity candle of the present invention is ideal for use in wedding ceremonies, reaffirmation of vows ceremonies, anniversaries and other occasions.

I claim:

1. A unity candle, comprising a pair of elongated upright candle sections, each having upper and lower ends, an exterior surface and an exposed interior engagement surface, a pair of upright wicks, one on each of the respective candle sections and extended longitudinally thereof at a position substantially closer to the exposed interior engagement surface thereof than to the exterior surface thereof, the engagement surface of each candle section being matched with the engagement surface of the other candle section such that, upon placement of the matched engagement surfaces in registered engagement, a single candle is formed, and said wicks extending upwardly from the upper surfaces of said candle sections and being so positioned on the respective candle sections that, upon placement of the matched interior engagement surfaces in registered engagement and upon lighting of the wicks, flames from the separate wicks are merged into one.

2. The unity candle of claim 1 wherein each exterior surface is generally semi-cylindrical.

3. The unity candle of claim 2 wherein each interior engagement surface is substantially flat.

4. A unity candle, comprising at least three elongated upright candle sections, each having upper and lower ends, an exterior surface and at least one exposed interior engagement surface, a plurality of upright wicks, one on each of the respective candle sections and extended longitudinally thereof at a position substantially closer to the exposed interior engagement surface thereof than to the exterior surface thereof, the engagement surfaces of each candle section being matched with the engagement surfaces of the other candle sections such that, upon placement of the matched engagement surfaces in registered engagement, a single candle is formed, and said wicks extending upwardly from the upper surfaces of said candle sections and being so positioned on the respective candle sections that, upon placement of the matched interior engagement surfaces in registered engagement and upon lighting of the wicks, flames from the separate wicks are merged into one.

5. The unity candle of claim 4 wherein each candle section is generally wedge-shaped so as to include a pair of engagement surfaces.

6. The unity candle of claim 5 wherein each candle section is generally pie-shaped whereby the exterior surface thereof is arcuate.

7. A unity candle, comprising a pair of elongated upright candle sections, each having upper and lower ends, an exterior surface and an exposed interior engagement surface, a pair of upright wicks, one on each of the respective candle sections closely adjacent the exposed interior engagement surface thereof, the engagement surface of each candle section being matched with the engagement surface of the other candle section such that, upon placement of the matched engagement surfaces in registered engagement, a single candle is formed, and said wicks extending upwardly from the upper surfaces of said candle sections and being so positioned on the respective candle sections that they are placed in adjacent relation upon placement of the matched interior engagement surfaces in registered engagement whereby flames from the separate wicks will be merged into one, each wick being positioned on the engagement surface of the respective candle section.

8. The unity candle of claim 7 wherein each wick is transversely centered on the respective exposed engagement surface.

* * * * *